US007640781B2

(12) United States Patent
Rose

(10) Patent No.: US 7,640,781 B2
(45) Date of Patent: Jan. 5, 2010

(54) METHOD FOR OPENING A JAMMED OR STUCK DOOR OF A VEHICLE

(75) Inventor: Scot Rose, Oglesby, IL (US)

(73) Assignee: Ibis Tek, LLC, Butler, PA (US)

( * ) Notice: Subject to any disclaimer, the term of this patent is extended or adjusted under 35 U.S.C. 154(b) by 0 days.

(21) Appl. No.: 11/707,664

(22) Filed: Feb. 16, 2007

(65) Prior Publication Data

US 2007/0220945 A1 Sep. 27, 2007

Related U.S. Application Data

(60) Provisional application No. 60/785,954, filed on Mar. 24, 2006.

(51) Int. Cl.
*B21J 13/08* (2006.01)
*B21C 1/00* (2006.01)

(52) U.S. Cl. ..... 72/457; 72/705

(58) Field of Classification Search ..... 72/705, 72/457; 294/82.11, 82.13
See application file for complete search history.

(56) References Cited

U.S. PATENT DOCUMENTS 261,629 A * 7/1882 Raymond ..... 294/82.13
3,667,660 A * 6/1972 Lewis ..... 225/1

* cited by examiner

*Primary Examiner*—Dana Ross
*Assistant Examiner*—Teresa M Bonk
(74) *Attorney, Agent, or Firm*—Ware, Fressola, Van der Sluys & Adolphson LLP

(57) ABSTRACT

A rescue device and a method of using same, for opening a jammed or stuck door of a vehicle, including a door having battle latches.

4 Claims, 5 Drawing Sheets

METHOD FOR OPENING A JAMMED OR STUCK DOOR OF A VEHICLE

CROSS REFERENCE To RELATED APPLICATION

Reference is made to and priority claimed from U.S. provisional application Ser. No. 60/785,954 filed Mar. 24, 2006.

BACKGROUND OF THE INVENTION

1. Technical Field

The present invention pertains to the field of equipment used in rescuing occupants from a vehicle. More particularly, the present invention provides equipment and a method for opening a door of a vehicle that has been jammed shut or is stuck due for example to a collision or because of being damaged in combat operations.

2. Problem Solved by the Invention

The HMMWV (High Mobility Multipurpose Wheeled Vehicle) is used e.g. by the U.S. Military in a number of missions including combat missions. In combat operations the doors of the HMMWV can jam shut due e.g. to impact by blast or fragment from an explosive device, or even due simply to a collision (in either combat or non-combat operations). The windows are relatively small in dimensions, and when the doors become jammed, the occupants are trapped. If the vehicle is in a hostile area, it is critical that the occupants be freed from the vehicle as soon as possible. Even if the vehicle in not in a hostile area, because of the risk of fire the occupants should be freed as soon as possible. Various methods have been tried, but because of the use of "battle latches" as well as a standard latch for the HMMWV doors, even pry bars and sledge hammers have proven ineffective.

So what is needed is a way to open the doors to the HMMWV when they are jammed or stuck shut. Ideally, a device for opening the doors of the HMMWV would also be useful for opening the doors of other vehicles, especially military vehicles.

BRIEF DESCRIPTION OF THE DRAWINGS

The features and advantages of the invention will become apparent from a consideration of the subsequent detailed description presented in connection with accompanying drawings, in which.

THE INVENTION

The invention will now be described in case of its use by a rescue vehicle in opening the driver side front door of a damaged HMMWV in a hostile area, so that the rescue vehicle and the damaged vehicle could come under attack or are already under attack. For combat, the HMMWV door is shut using three battle latches as well as a standard latching system.

Figure 1:
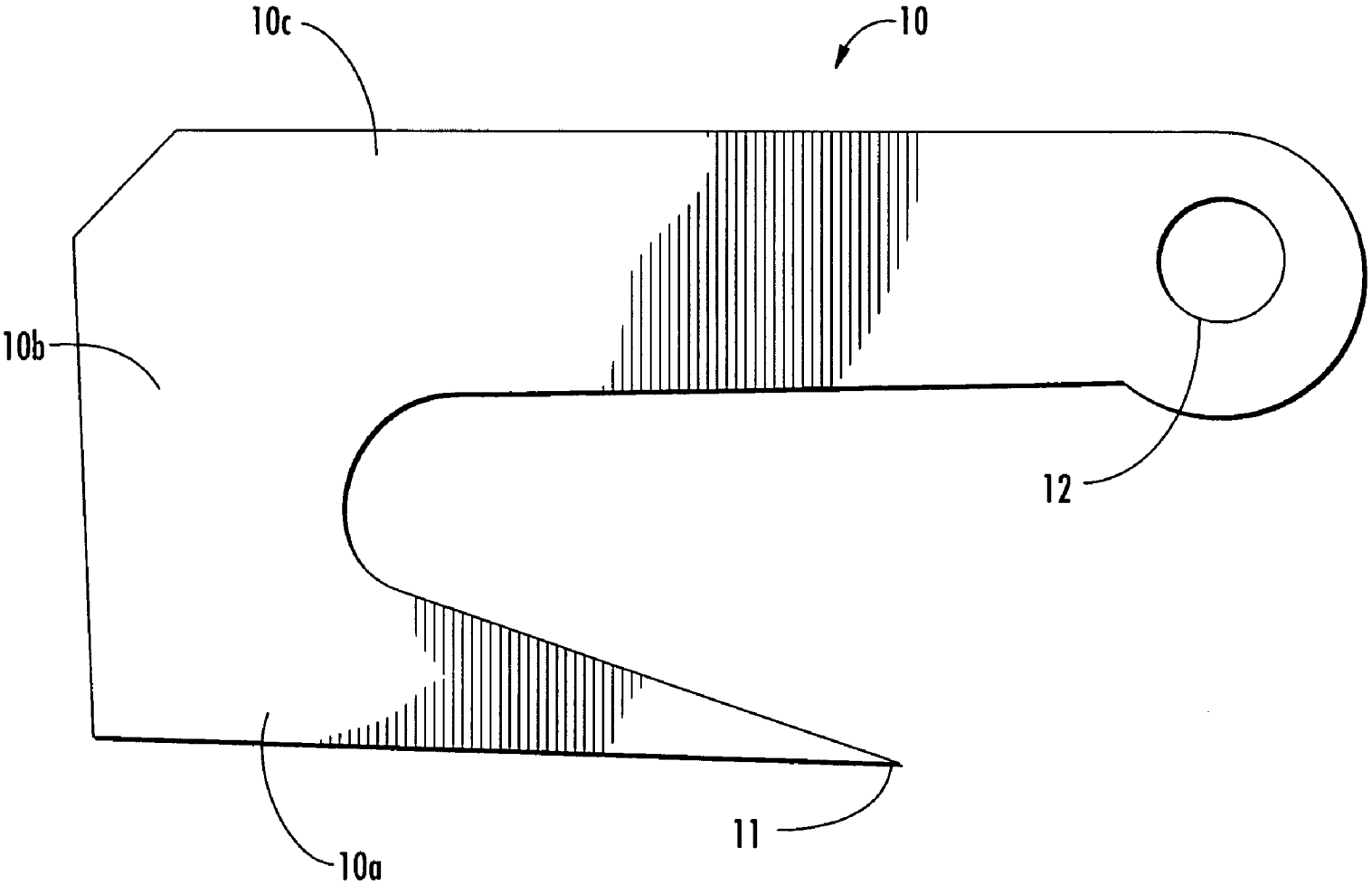
FIG. 1 is a sketch of a claw used as part of a rescue device according to the invention.
Figure 2:
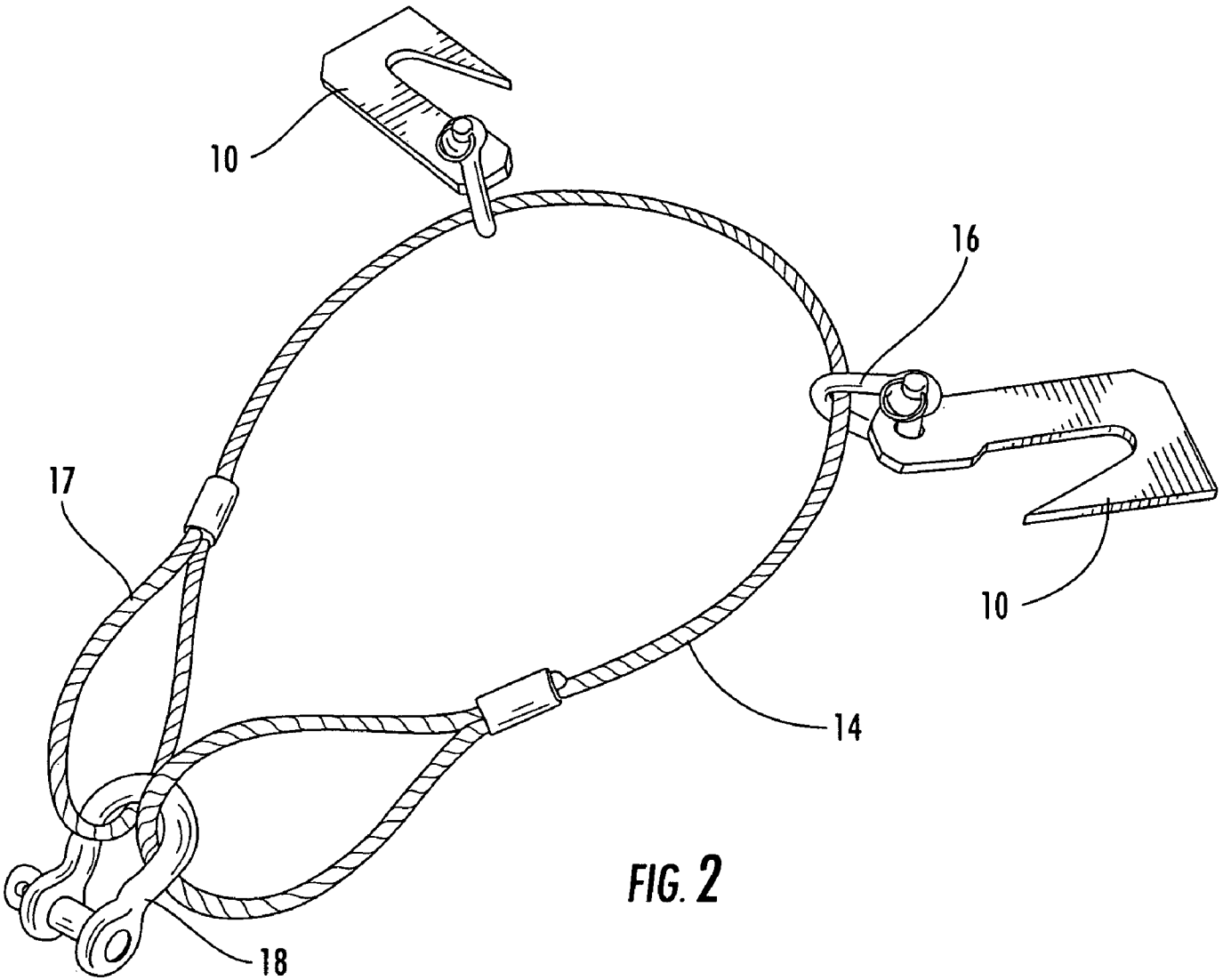
FIG. 2 is a photograph of the portion of an embodiment of a rescue device according to the invention that includes two claws as in FIG. 1, and a claw coupling cable connecting the two claws.
Figure 3:
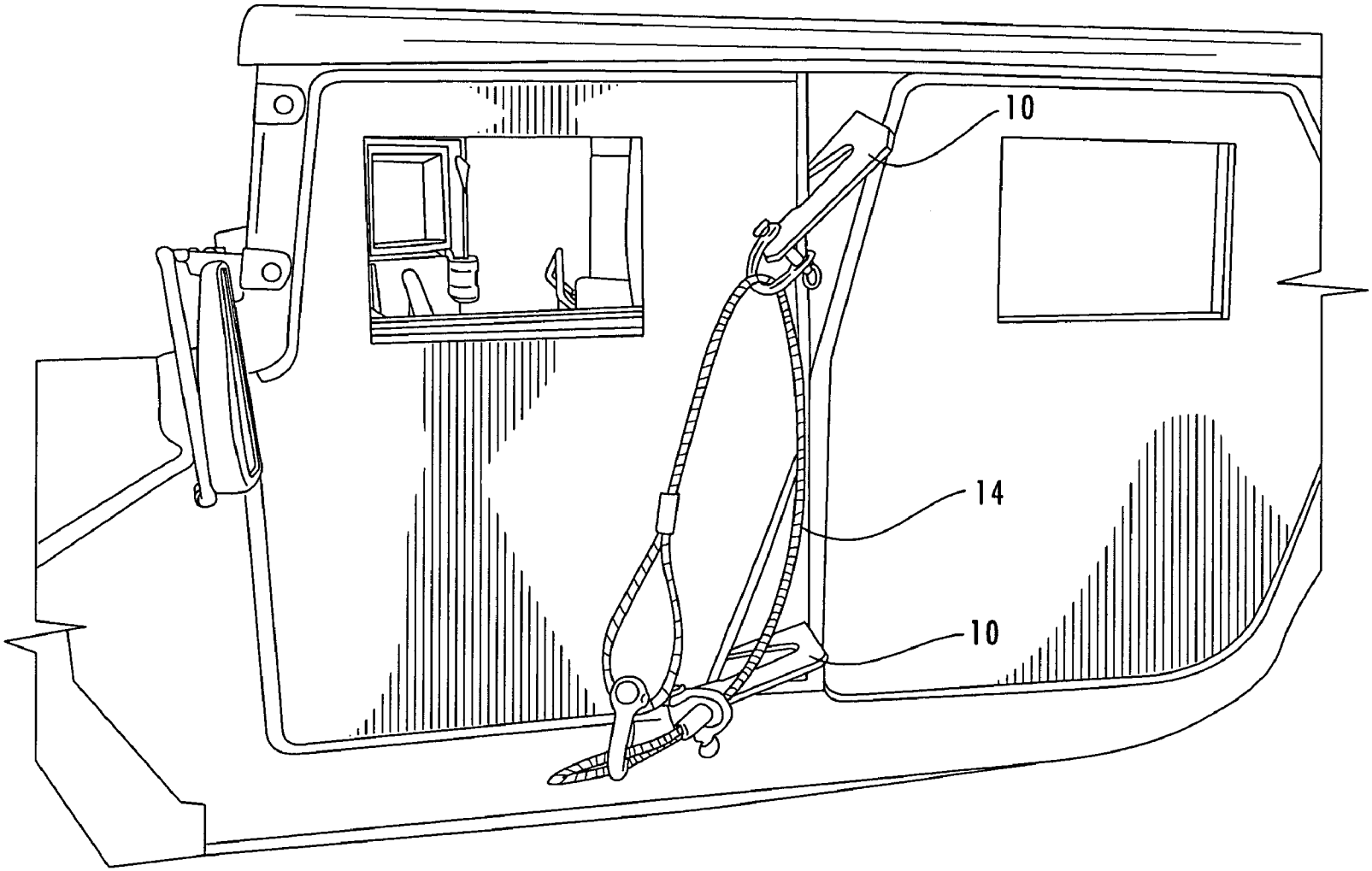
FIG. 3 is a photograph of the portion of the rescue device shown in FIG. 2 and attached to the door of a vehicle.
Figure 4:
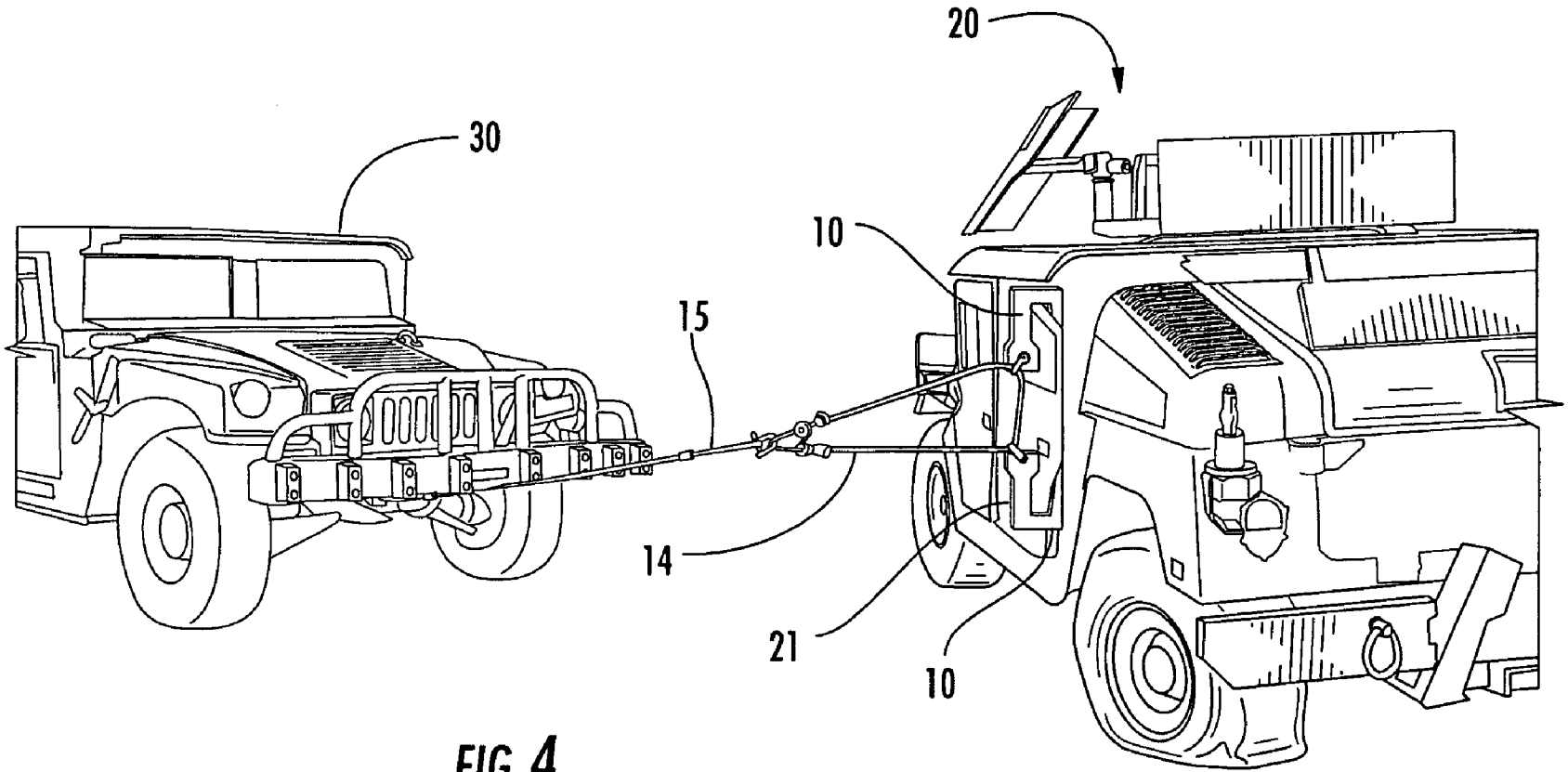
FIG. 4 is a photograph of the entire rescue device, including a leader cable for connecting the claw coupling cable to a rescue vehicle, with the claws positioned to open a jammed or stuck door of a damaged vehicle.
Figure 5:
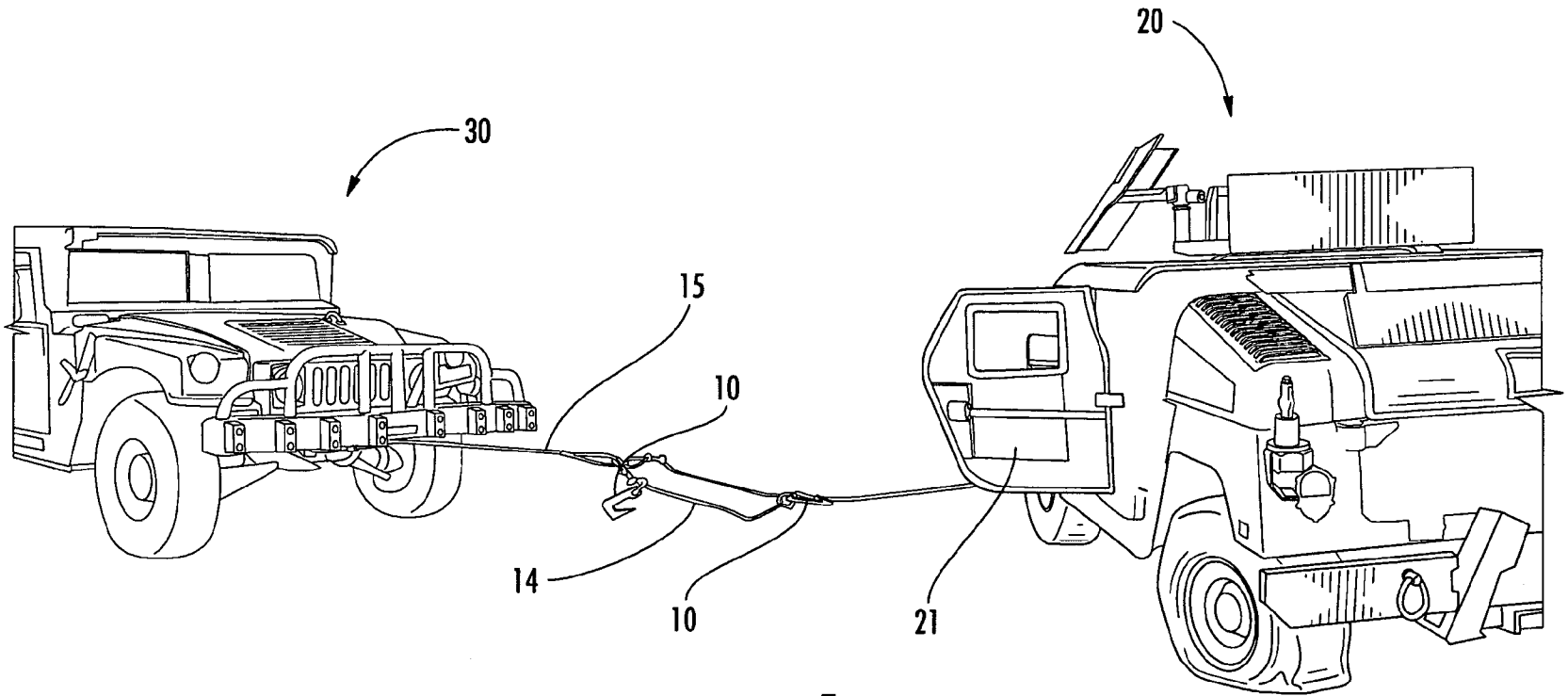
FIG. 5 is a photograph showing the damaged vehicle with the door after it is opened using the rescue device.

Referring to FIGS. 1-5, the invention provides a rescue device—called here a "rat's claw"—for opening a jammed or stuck door 21 (FIG. 3) of a damaged vehicle 20, using a rescue vehicle 30 to which one end of the rescue device is attached, to pull on the rescue device which is attached at the other end to the jammed or stuck door using one or more special hook structures or claws 10 (FIG. 1). The claws 10 have an annular portion 12 and a pointed end 11. The pointed end of each claw is slid or forced between the jammed or stuck door and the body of the vehicle, at an orientation where the annular portion extends away from the body of the vehicle (see FIG. 3). The claws 10 are connected via a claw coupling cable 14 (FIG. 2) passing through U-bolts piercing the annular region of each claw. The claw coupling cable terminates in a loop 17 at each end. The two loops are then connected using a loop connector (a U-bolt) 18. A leader cable 15 is then also connected to the loop connector at one end, and is fastened to the (front or rear of the) rescue vehicle at the other end. The leader cable at the rescue vehicle end includes a hook (not visible in the Figs.) having an arch that fits most rings, pintel hitches, tow cables/straps and under carriage components used on military vehicles.

Prior to attaching the leader cable to the rescue vehicle, the rescue vehicle is pulled close enough to the damaged vehicle that after attaching the rescue device to both the damaged vehicle and the rescue vehicle, there is typically about from two to three feet of slack in the tension cable and claw coupling cable (so that the rescue vehicle must pull away two or three feet to take up all slack). When the rescue device is fully connected (to both vehicles), the rescue vehicle is made to pull away from the damaged vehicle (FIGS. 4 and 5) in a direction suitable for opening the damaged or stuck door, i.e. more or less toward the front of the vehicle, so as to be at approximately the 10 o'clock position relative to a driver in the damaged vehicle when opening a door on the driver side. In pulling away, the rescue vehicle is made to accelerate to about two or three mph in about the two or three foot of slack. This results in a sudden force or snapping action of the claws on the damaged or stuck door, which has been observed to be sufficient to open such a door under most circumstances. Having the rescue vehicle at the 10 o'clock position for a driver side door opening—or more generally forming a V-shape with the damaged vehicle—sets up the proper angle (sweet spot) for breaching and gives cover to the rescue team should they come under attack.

One-half inch cable is used everywhere in constructing the rescue device, with the hardware (U-bolts and loop closure pieces) sized correspondingly. For use in opening doors of a HMMWV or similarly sized vehicle using another similarly sized vehicle as the rescue vehicle, the leader cable is approximately 6' (about 2 m) in length (and ½" in diameter), and the claw coupling cable is also approximately 6' in overall length (before the ends are joined together by the loop connector 18). This is a combination that works well, is small and light enough to be deployed quickly and easily, and yet allows enough space between the vehicles with the required slack to create the desired snapping action.

The leader cable and claw coupling cables can be various lengths, some more suitable than others, depending on the kinds of vehicle used as the rescue vehicle and the kinds of vehicle being rescued. Also, instead of hooking to the rescue vehicle, the leader cable can be looped over a protuberance on the vehicle, in which case it is advantageously a little longer (a few feet longer) than for applications where the cable attaches by a hook or arch to the rescue vehicle.

The rescue device can be deployed by one person but works better if two people work together. Assuming here that two people work together to open a jammed or stuck driver door, one person grabs the two claws and attaches them to the driver door at different points, each providing a good grip. Because of damage, the best point of attachment may differ in different rescue operations, even in case of the same model/kind of vehicle. Often, doors are deformed by the shock wave of an IED (improvised explosive device) so that a small space opens up where the sharp point of a claw can be inserted. If such a space is not available, the claws can be hung on the door anywhere where they will stay until tension is applied. Then as explained above, once the hooks are attached to the damaged vehicle, any rescue personnel not in the rescue vehicle take up a safe position (usually to the rear of the damaged vehicle). With some slack in the cable the rescue vehicle accelerates and creates a snapping motion. If done properly, this action fractures all three of the battle latches and the standard latching system on the door, and the door then flies open. The occupants of the damaged vehicle can then exit or be removed from the vehicle.

The rescue device is not limited to use according to the above description. In particular for example, the rescue vehicle can pull up to a damaged vehicle so as to meet face to face, and then back up (quickly) to snap open a damaged or shut door.

In inserting the claws into the doors of the damaged vehicle, there is usually no need to try and drive the claws into the door. The factory door in its original configuration is recessed in the frame of the vehicle, which allows the claws to attach without having to be driven into the door. The sharp point of each claw can be inserted to only a small depth in an opening between the jammed or shut door and the body of the damaged vehicle—i.e. the rescuer need not attempt to insert the claw to a greater depth—and as pressure is applied, the sharp point of the claw will sink deeper into the opening. Manufactured holes in the main frame under a vehicle also provide a place to quickly put the sharp points (wedge points) of the claws in the event of a rollover or in case of a water accident.

As mentioned, the cable must have some slack to achieve a snapping motion when the rescue vehicle pulls away from the damaged vehicle. It is the snapping motion that breaks the latches of the door. Backing up until the cable is taught, and then using a steady pull is not likely to work.

The rescue device has been tested and the inventor has found that it allows opening a jammed or stuck door within a three-minute period.

The rescue device includes at least two claws. A single claw, which of course would greatly simplify the rescue device, is not as effective. For one thing, in case of operation in a hostile area where the rescue operation has to work the first time, two claws are preferable, two claws are less likely than one to move and come free as the slack is taken up (because of the weight of the cabling). Moreover, there seems to be a greater mechanical advantage using two (or more) claws than using a single claw.

Referring again to FIG. 1, each claw structure includes three legs, a distal leg 10*a* terminating in the pointed end 11, an intermediate leg 10*b* perpendicular to the distal leg and connected to the distal leg at one end and serving as a strength member, and a proximal leg 10*c* perpendicular to the intermediate leg and connected at one end to the end of the intermediate leg not connected to the distal leg. As shown, for use in opening the doors of a HMMWV or similarly sized vehicle, the claw structure is advantageously made from a steel plate nominally ½" thick, and has overall dimensions of nominally 10 and ½" by 4", with the distal leg having a length of nominally 6 and ½".

In some embodiments, the a third line or cable is attached to the loop connector 18 at one end, and to a point toward the front of the damaged vehicle. This gives a third point of attachment to the damaged vehicle, the other two provided by the two claws. With the third point of attachment, when the door flies open and the claws come free, the claws cannot whip away from the damaged vehicle and possibly cause damage or injury to nearby personnel or equipment. The third point of attachment remains in place and holds the claws close to the line between the third point of attachment and the point on the rescue vehicle where the leader cable is attached. Such a safety measure is not needed by one skilled in the use of the rescue device provided by the invention: if the cabling of the rescue device is chosen suitably, the rescue vehicle need not back up or pull away so quickly as to endanger nearby personnel or risk damage to nearby equipment when the claws come free of the damaged or stuck door.

It is to be understood that the above-described arrangements are only illustrative of the application of the principles of the present invention. Numerous modifications and alternative arrangements may be devised by those skilled in the art without departing from the scope of the present invention, and the appended claims are intended to cover such modifications and arrangements.

What is claimed is:

1. A method for opening a door of a target vehicle using a rescue vehicle, comprising the steps of:

(a) providing an apparatus for use in opening the door of the target vehicle using a rescue vehicle, comprising:

(i) a plurality of claw structures, each having a pointed end dimensionally sized for inserting or wedging into a peripheral opening defined around the door of the target vehicle between the body of the target vehicle and a peripheral edge of the door of the target vehicle and engaging the peripheral edge of the door;

(ii) a claw coupling cable attaching together the claw structures so as to allow a pulling force to be applied to all the claw structures by pulling only on the claw coupling cable; and (iii) a tension cable having one end attached to the claw coupling cable and another end for attaching to the rescue vehicle to apply the pulling force on the claw structures and the claw coupling cable attached thereto;

(b) inserting a pointed end of each of a plurality of claw structures into the peripheral opening defined around the door of the target vehicle and engaging the peripheral edge of the door of the target vehicle;

(c) attaching one end of the tension cable to the claw coupling cable;

(d) attaching the other end of the tension cable to the rescue vehicle with the rescue vehicle positioned close enough to the target vehicle that the tension cable is slack; and (e) pulling the rescue vehicle away from the target vehicle to take up the slack in the tension cable and cause a snapping action as the slack is taken up in the tension cable to pull open the door of the target vehicle.

2. A method as in claim 1, wherein each claw structure includes a distal leg terminating in the pointed end, an intermediate leg perpendicular to the distal leg and connected to the distal leg at one end and a proximal leg perpendicular to the intermediate leg and connected at one end to the end of the intermediate leg not connected to the distal leg.

3. A method as in claim 1, wherein the claw structure is made from a steel plate nominally ½" thick, and has overall dimensions of nominally 10 and ½" by 4", with the distal leg having a length of nominally 6 and ½".

4. A method as in claim 1, wherein all the claw structures are slidably movable along the claw coupling cable to allow the claw structures to be positioned in various locations in the peripheral opening defined around the door of the target vehicle between the body of the target vehicle and the peripheral edge of the door of the target vehicle.

* * * * *